United States Patent [19]

Peterson

[11] 4,033,013

[45] July 5, 1977

[54] FLEXIBLE MAGNETIC PLASTIC STRIP CLOSURE

[76] Inventor: John Elwood Peterson, 90 Kent Court, Apt. 19, Daly City, Calif. 94015

[22] Filed: Nov. 18, 1975

[21] Appl. No.: 633,028

[52] U.S. Cl. ..... 24/201 B; 248/206 A; 292/251.5; 150/3

[51] Int. Cl.[2] ..... E05C 19/16; A44B 17/00

[58] Field of Search ..... 24/201 B, 73 MS, 201 C; 150/3, 5, 42; 229/65; 206/818; 248/206 A; 292/251.5

[56] References Cited

UNITED STATES PATENTS

| | | | |
|---|---|---|---|
| 2,124,298 | 7/1938 | Hiering | 150/42 |
| 2,288,688 | 7/1942 | Dubilier | 248/206 A |
| 2,627,097 | 2/1953 | Ellis | 24/201 B |
| 2,693,837 | 11/1954 | Klein | 150/42 |
| 3,237,327 | 3/1966 | Griggs | 218/206 A |
| 3,275,053 | 9/1966 | Kabana | 150/42 |
| 3,326,399 | 6/1967 | Ausmit | 150/3 |
| 3,468,576 | 9/1969 | Beyer et al. | 292/251.5 |
| 3,749,301 | 7/1973 | Peckar | 248/206 A |

*Primary Examiner*—Paul R. Gilliam
*Assistant Examiner*—Victor N. Sakran

[57] ABSTRACT

A closure for a flexible case such as a brief case, purse or the like, wherein opposing flexible magnetic plastic strips border the opening or mouth of the case, the opposing strips being arranged to be of opposite polarity to develop an attraction force between them. Opposed opening tabs may be provided in such manner as to facilitate opening of the case without tendency to inadvertently remove the strip from its location of attachment, while corner clips effectively reinforce the upper corners of the case.

4 Claims, 7 Drawing Figures

FLEXIBLE MAGNETIC PLASTIC STRIP CLOSURE

My invention relates to flexible cases such as brief cases, purses and the like, and more particularly to a closure for such cases.

Various types of closures for such cases are known, but each, aside from its virtues, has its drawbacks, such as cost of installation, breakage, etc.

Among the objects of my invention are:

1. To provide a novel and improved closure for a flexible case such as a brief case, purse, etc.;

2. To provide a novel and improved closure for a flexible case which will be very easy to install;

3. To provide a novel and improved closure for a flexible case which will close the opening for, effectively, the full length thereof;

4. To provide a novel and improved closure for a flexible case which is self-sealing and very readily opened;

5. To provide a novel and improved closure for a flexible case which is not only simple in structure but ruggedly constructed and will render long service.

Additional objects of my invention will be brought out in the following description of a preferred embodiment of the same, taken in conjunction with the accompanying drawings wherein.

Figure 1:
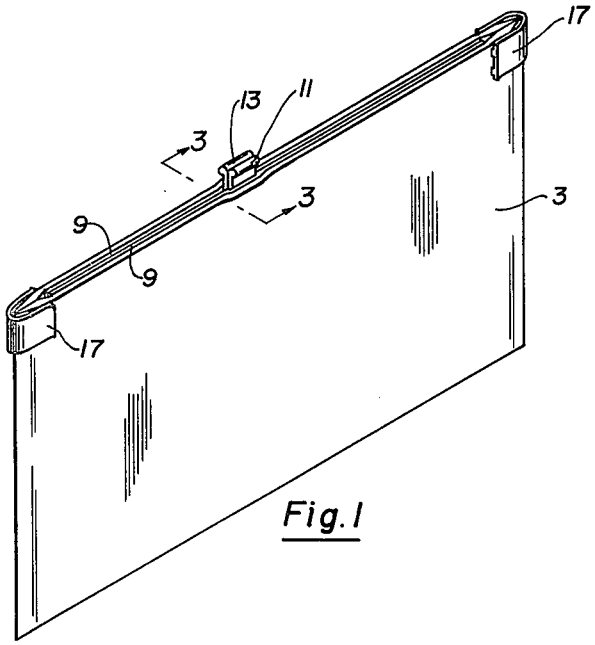
FIG. 1 is a three dimensional view of the invention in the form of a flexible brief case and showing the same in its closed condition.
Figure 2:
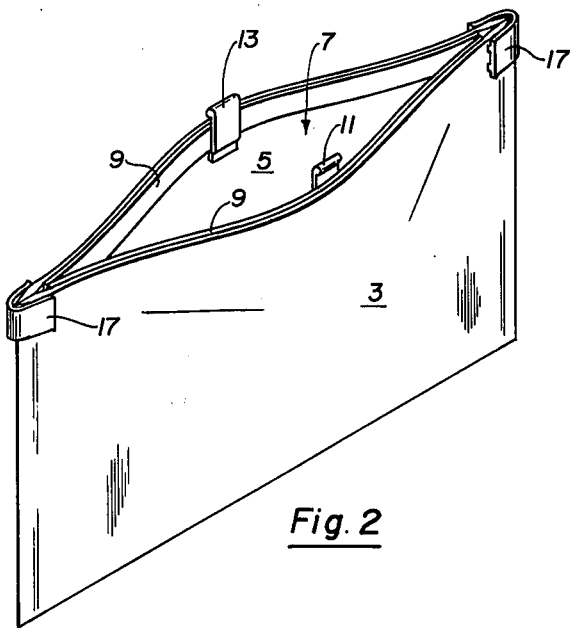
FIG. 2 is a corresponding view but showing the brief case in its open condition.
Figure 5:
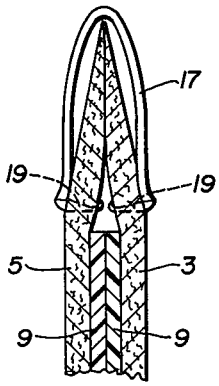
FIG. 5 is a view in section illustrating in detail, the manner in which upper corners of the case are reinforced, utilizing the clip of FIG. 4.
Figure 3:
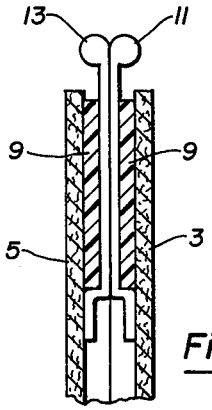
FIG. 3 is a view taken in the plane 3—3 of FIG. 1 and depicting opening tabs for a flexible case.
Figure 4:
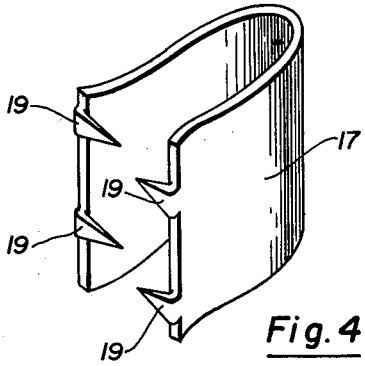
FIG. 4 is a three dimensional view of a clip employed in the preferred embodiment of the invention as illustrated in FIGS. 1 and 2.
Figure 7:
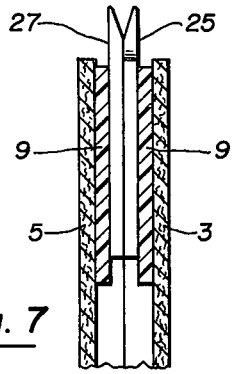
FIG. 7 is a view in section taken in the plane 7—7 of FIG. 6.
Figure 6:
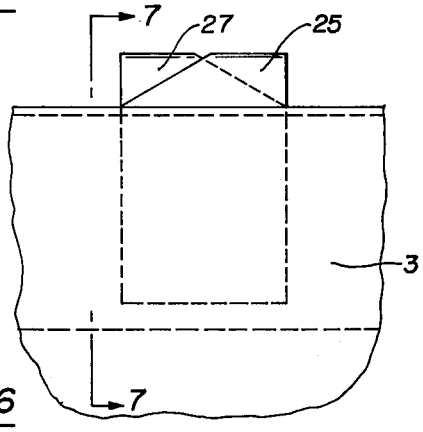
FIG. 6 is a frontal view depicting a modified form of opening tabs.

Referring to the drawings for details of the invention in its preferred form, the invention is shown as applied to a flexible brief case involving a pair of side walls 3, 5 formed by folding a sheet of the case material and adhesively securing the resulting side walls to each other along the side edges, leaving the mouth or opening 7 of the brief case long the upper edge thereof. The adhesively secured edges are first preferably chambered along the inner sides thereof, to which the adhesive is then applied.

Affixed along the upper inside edge of each side wall and bordering the opening of the case, is a flexible magnetic strip 9 which is preferably affixed with a suitable adhesive. These strips preferably terminate short of the side edges of the side walls to facilitate the adhesive securing of the side walls and thus allow maximum freedom in the opening and closing of the case.

By installing each strip with the polarity of one opposite to that of the other strip, a force of attraction will develop along the entire length of the strips which, in the open condition of the case, will increase as one moves from the center of the opening toward each end thereof where the force of attraction is maximum. Thus, in the open condition of the case, there exists at all times, a tendency for the case to becomes self closing, and when such gradually increasing force of attraction is sufficient to overcome the buckle of the side walls, as when the sides of the opening are urged toward each other, the case will close automatically and seal the opening for the entire length thereof.

To thereafter open the case, all that is necessary is to grasp the upper edges of the side walls and apply a spreading force sufficient to overcome the attraction between the opposed magnetic plastic strips.

Repeated openings of the case, may have a tendancy to effect a separation of the plastic strip from its adhesion to its associated side wall at the point of application of such separating force, and to obviate this probability, I provide a pair of opening tabs 11, 13 each located in the center region of the upper edge of its associated side wall in opposed relationship to the other, each being secured at its lower end to the inner surface of the side wall and extended across the proximate plastic strip to a point above where it will be accessible. By grasping these tabs and exerting a separation force, a case will be readily opened without any tendancy to effect separation of either of the strips from the side wall to which it is adhesively secured. In fact, the force applied to the tabs in opening the case, will tend to maintain the strip in its bonded relationship to the proximate side wall.

When the side walls of the case are adhesively secured along their edges as previously indicated, it might be desirable to reinforce the upper corners of the case to avoid probable opening of the seams at these points following repeated opening and closing of the case.

To effect such reinforcement at the upper corners, I apply a clip 17 at each corner which clip is of U-shape to straddle the corner, and is provided with inwardly directed offset teeth 19 each approximately two thirds the double thickness of the case material and adapted to be passed through a side wall of the case and then bent over.

While the invention has been described in connection with a briefcase of the type illustrated, the briefcase may be of the character wherein one of the side walls extends sufficiently above the other to permit of it being folded over the opening to form a flap to be secured to the outer surface of the resulting shorter wall, In such type of case, one of the strips will be applied to the inner surface of the free edge of the flap, while the second strip will be suitably located along the outer surface of the shorter wall.

In lieu of the opening tabs described above, one might form tabs 25, 27 of flexible magnetic strip material and install them in slightly offset relationship with respect to each other and with each magnetically attracted to its proximate closure strip to which it will also be adhesively secured to preclude shifting.

In lieu of opening tabs, matching handles may be riveted at corresponding locations, through the case material and proximate strip.

From the foregoing description of my invention in its preferred form, it will be apparent that the same fulfills all the objects of the invention attributed thereto, and while I have illustrated and described the same in considerable detail, it will further be apparent that the same is subject to alteration and modification without departing from the underlying principles involved, and I, accordingly, do not desire to be limited in my protection to the specific details illustrated and described, except as may be necessitated by the appended claims.

I claim:

1. A closure for a flexible case or the like having flexible side walls forming a mouth opening, a first strip of flexible magnetic tape, means securing said first strip of flexible magnetic tape to one of said flexible side walls, a second strip of similar length of such tape, means securing said second strip to said other side wall in position to be engaged by said first strip, said strips having opposite exposed polarities to effect a normal attraction of one for the other when in proximity to each other, and at least one opening tab extending at one end at least partially across the inner or exposable surface of one of said strips of flexible magnetic tape and, at its other end, extending beyond the proximate edge of said side walls, whereby application of finger pressure thereto to separate said strips and open said flexible case, will not strain said securing means. wherein, said closure is characterized by a pair of opening tabs, each of said tabs being affixed at one end to the inner or exposable surface of a different one said strips and extending upwaredly to a point above the proximate edges of said side walls, with both said openings tabs being located within a central region of the associated side walls 2. A closure in accordance with claim 1, characterized by said tabs being slightly offset with respect to each other.

3. A closure in accordance with claim 2, characterized by said flexible magnetic strips terminating short of the ends of said side walls, and clips embracing proximate ends of said side walls at the upper corners thereof.

4. A closure in accordance with claim 1, characterized by said tabs being magnetically polarized and of opposite polarity.

* * * * *

UNITED STATES PATENT OFFICE

CERTIFICATE OF CORRECTION

Patent No. 4,033,013 Dated July 5, 1977

Inventor(s) John Elwood Peterson

It is certified that error appears in the above-identified patent and that said Letters Patent are hereby corrected as shown below:

Column 3, line 17, after "means" delete the period.

Column 4, line 6, after "walls" insert a period.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,033,013 Dated July 5, 1977

Inventor(s) John Elwood Peterson

It is certified that error appears in the above-identified patent and that said Letters Patent are hereby corrected as shown below:

Claim 1 should be deleted in its entirety and should appear as follows:

1. A closure for a flexible case or the like having flexible side walls forming a mouth opening, a first strip of flexible magnetic tape, means securing said first strip of flexible magnetic tape to one of said flexible side walls, a second strip of similar length of such tape, means securing said second strip to said other side wall in position to be engaged by said first strip, said strips having opposite exposed polarities to effect a normal attraction of one for the other when in proximity to each other, and a pair of opening tabs, each of said tabs being affixed at one end to the inner or exposable surface of a different one of said strips and extending upwardly to a point above the proximate edges of said side walls, with both said openings tabs being located within a central region of the associated side walls, whereby application of finger pressure thereto to separate said strips and open said flexible case, will not strain said securing means.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*